US007997052B2

(12) United States Patent
Terra

(10) Patent No.: US 7,997,052 B2
(45) Date of Patent: Aug. 16, 2011

(54) STATIONARY COMPACTING, BAGGING MACHINE

(76) Inventor: Edson Mario Salamoni Terra, Canoas (BR)

( * ) Notice: Subject to any disclaimer, the term of this patent is extended or adjusted under 35 U.S.C. 154(b) by 0 days.

(21) Appl. No.: 12/845,713

(22) Filed: Jul. 28, 2010

(65) Prior Publication Data

US 2010/0287895 A1 Nov. 18, 2010

Related U.S. Application Data

(63) Continuation of application No. PCT/BR2009/000024, filed on Jan. 29, 2009.

(30) Foreign Application Priority Data

Jan. 29, 2008 (BR) ..... 8800953 U

(51) Int. Cl.
*B65B 1/24* (2006.01)

(52) U.S. Cl. ..... 53/527; 52/438; 52/530; 100/218; 100/219

(58) Field of Classification Search ..... 53/438, 53/439, 527, 529, 530; 100/218, 219, 220, 100/251, 126, 188 R, 295
See application file for complete search history.

(56) References Cited

U.S. PATENT DOCUMENTS 358,375 A * 2/1887 Billings ..... 100/99
1,861,391 A * 5/1932 Hall ..... 100/250
3,211,193 A * 10/1965 Anderson ..... 141/73
3,580,166 A * 5/1971 Longo ..... 100/49
3,587,448 A * 6/1971 Hemphill et al. ..... 100/3
3,708,953 A 1/1973 Aluotto
3,785,281 A * 1/1974 Ligh ..... 100/116
3,802,337 A * 4/1974 Fernando St-Hilaire ... 100/98 R
3,808,766 A * 5/1974 Hutchinson et al. ..... 53/436
3,821,929 A * 7/1974 Stapf ..... 100/179
4,013,181 A * 3/1977 Johnson ..... 414/512
4,036,124 A * 7/1977 Seiler et al. ..... 100/98 R
4,334,466 A * 6/1982 Spiegelberg ..... 100/4
4,885,899 A * 12/1989 Hutchinson ..... 53/527
5,459,982 A * 10/1995 Long ..... 53/529
6,431,062 B1 * 8/2002 Hawlas et al. ..... 100/188 R

OTHER PUBLICATIONS

International Application Status Report—PCT/BR2009/000024; WO 2009/094737.
International Application Published under PCT (with International Search Report) —PCT/BR2009/000024; WO 2009/094737.
Related Documents at the International Bureau—PCT/BR2009/000024; WO 2009/094737.
U.S. Appl. No. 12/845,716, filed Jul. 28, 2010.

* cited by examiner

*Primary Examiner* — Thanh K Truong
(74) *Attorney, Agent, or Firm* — Patent Law Agency, LLC; Peter Ganjian

(57) ABSTRACT

Stationary compacting, bagging machine comprising a structure intended to compact sorted or unsorted waste inside bags manufactured in laminated polypropylene adequate for this purpose, in which said equipment can perform high compaction of waste, extracting the liquid arising from compaction and eliminating empty spaces between the different kinds of materials, in such a manner that these bags can be deposited in proper landfills with no leaks into the atmosphere nor contamination of the groundwater.

1 Claim, 4 Drawing Sheets

STATIONARY COMPACTING, BAGGING MACHINE

CROSS-REFERENCE TO RELATED APPLICATIONS

This Application is a CONTINUATION application claiming the benefit of priority of the co-pending International Patent Application No. PCT/BR2009/000024 with an international filing date of 29 Jan. 2009 that designated the United States, which claims the benefit of priority of BRAZIL Patent Application No. MU 8800953-0, filed 29 Jan. 2008, the entire disclosures of all Applications are expressly incorporated by reference in their entirety herein.

INCORPORATION BY REFERENCE

All publications and patent applications mentioned in this specification are herein incorporated by reference to the same extent as if each individual publication or patent application was specifically and individually indicated to be incorporated by reference.

TECHNICAL FIELD

The following descriptive report of the application of this utility model refers to the development of a stationary compacting, bagging machine that comprises a structure intended to compact sorted or unsorted waste inside bags of laminated polypropylene adequate for this purpose, in which said equipment can perform high compaction of the waste, extracting liquids arising from the compaction and eliminating empty spaces between different kinds of materials, in such a manner that these bags can be deposited in proper landfills. They are equipped with gas capture devices so there are no leaks into the atmosphere and do not contaminate the ground water because they are impermeable.

STATE OF THE ART

The waste compaction is an operation used a great deal in the selective waste collection in order to reduce the amount of waste so that it can be transported a lot more efficiently and at a lower cost.

Said compaction can be performed either by means of stationary compactors in order to compress smaller amounts of waste or by waste compacting trucks that are equipped with a hydraulic or pneumatic press that compresses the waste in the closed dump body of the truck. When the truck arrives at the recycling unit, said closed dump body opens and unloads its contents for sorting and organic waste is disposed of at a landfill.

Different patents on the waste compaction were found in our search of the art relating to the technical field of the utility model (B65F 3/14, B30B 9/30, B65F 3/00, and B65F 3/12).

BRMU 7.302.211 by D'ÁVILLA et alii discloses a waste compacting collector installed on the chassis, which consists of a storage box with an ejecting plate equipped with a rear tipping structure fitted with a double-action cylinder, which contains a bucket with an inclinable system and simple stage control cylinders, and a compacting plate equipped with control cylinders, which, due to the simplicity of the concept, ensures more operator safety, easy maintenance, and easy operation both when loading and unloading waste and other debris, even providing a vehicle with more stability when in movement.

BRPI 0.102.505 by FERRI discloses another compactor in a waste collection recipient for a waste collection sorting truck intended for collection and transportation of recyclable industrial, household, and business waste, which consists of a compacting device attached to a recipient actuated by the differential of the vehicle, or, in another version, by an electric engine, and can be detached from the vehicle in order to be used inside the recycling station.

BRPI 0.300.016 by PRADO discloses waste collection and compaction equipment composed of four main sets as follows: a solid waste collection dump body, a compacting and ejection shield, a rear retention lid, and a moving inclinable container. The solid waste collection dump body is intended for collection of household, industrial, or hospital waste. The objective of the compacting and ejection shield is to compress the waste stored in the collection dump body in order to reduce the volume of the waste inside of it for the purpose of increasing its storage capacity, and also to unload the waste from the compartment. The rear retention lid is intended to retain the solid waste inside the cargo compartment and remains closed during the whole process of waste collection, said rear retention lid being opened only during the unloading process.

BRPI 9.904.545 by LAGO discloses a vertical semiautomatic press for recycling diverse materials, which allows compacting different materials of recyclable waste—cardboard, metals, plastic, and glass—in one piece of equipment only, all of them being duly deposited in the lower compartments of its structure.

All of the compactors described above do not have any kind of bagging after the high compression of the waste.

Two patents by FERIOLI describe means of compacting and then bagging waste.

An attached collecting, compacting, and a bagging apparatus intended for waste in general is described by BRPI 0.300.535 that refers to equipment, which can be self-transported or towed, intended to collect, compact, and bag household, industrial, and agricultural waste; and BRPI 0.206.617 that discloses an attached collecting and compacting apparatus for collecting household waste, which has to be hooked to a tractor that hauls it, and is connected to the power socket that the tractor has in order to transmit the hydraulic energy which is required by its operational parts, and which belongs to a type that comprises a chassis assembled under a directional front set and a rear set, on which the waste collecting box is supported and fixed, which includes a corresponding unloading gate.

The novelty of this invention is as follows: a waste collection box is a closed cargo and compaction enclosure that has a receiving lateral and front opening with the closing gates, inside of which operates a compacting plate disposed transversally at the free extremity of a coaxial hydraulic cylinder on the longitudinal axle of the enclosure, on which the said compacting plate moves horizontally from the anterior zone to the posterior zone of said enclosure, where it meets a contention plate on which the compaction is performed, said contention plate being a rear gate whose opening allows unloading the compacted waste.

PROPOSED DEVELOPMENT

Contrary to the two compactors disclosed by the previous art, the compacting, bagging apparatus which is being proposed is stationery, that is, the waste comes to it by means of trucks that unload it in proper places to be directly compacted or sorted and later bagged.

Therefore, due to the considerations relative to the state of art discussed above, one of the objectives of the application of this utility model is the development of a stationary compacting, bagging machine that comprises a structure which can perform high compression of waste collected by conventional trucks in such a manner that humidity and empty spaces existing in the waste are practically eliminated, and that, after this high compression, a compaction in the order of 10 kgf/cm$^2$, which reduces the initial amount of waste by more than four times, the waste is conditioned in laminated water-proof polypropylene bags whose tissue weight may vary from 120, 160 up to 180 g/cm$^2$ depending on the kind of waste that is bagged.

The bags are made to store several tons of highly compacted waste. The weight of the bags may vary and can exceed 4.5 tons (predominantly, organic waste), but may reach 3.5-4.0 tons when a great deal of dry waste is mixed.

The completely full bags store 5 m$^3$ of compacted waste, which is why they may absorb up to 20 m$^3$ of waste in its natural state since its compaction may reach 4 to 1.

According to the data provided by the manufacturer of the bag tissue, the durability of the bags if they are covered (with no contact with ultraviolet light) is 200 years. However, if exposed to sunlight, their duration is 6 months. In the event that the exposure to sunlight has to be longer (close to 3 years) the tissue can be protected with anti-UV layers.

DESCRIPTION OF THE FIGURES

This application for the patent of the utility model proposed herein is characterized by means of the drawings representative of the stationary compacting, bagging machine in such a manner that the equipment can be wholly reproduced by the adequate technique, allowing the full characterization of the functionality of the claimed objective.

The descriptive part of the report is based on the developed figures that express the best or preferred manner of implementing the product conceived herein through a detailed and consecutive numeration, in which it clarifies the aspects that may be implied by the adopted embodiment in order to clearly determine the protection claimed herein.

These figures are merely illustrative and may vary since they do not digress from what has been initially claimed herein.

Figure 2:
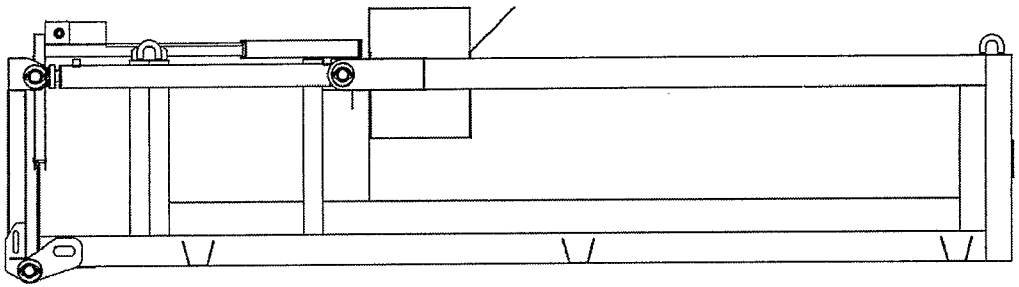
Figure 3:
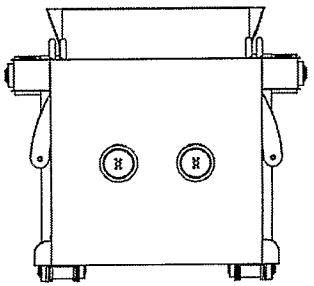
Figure 1:
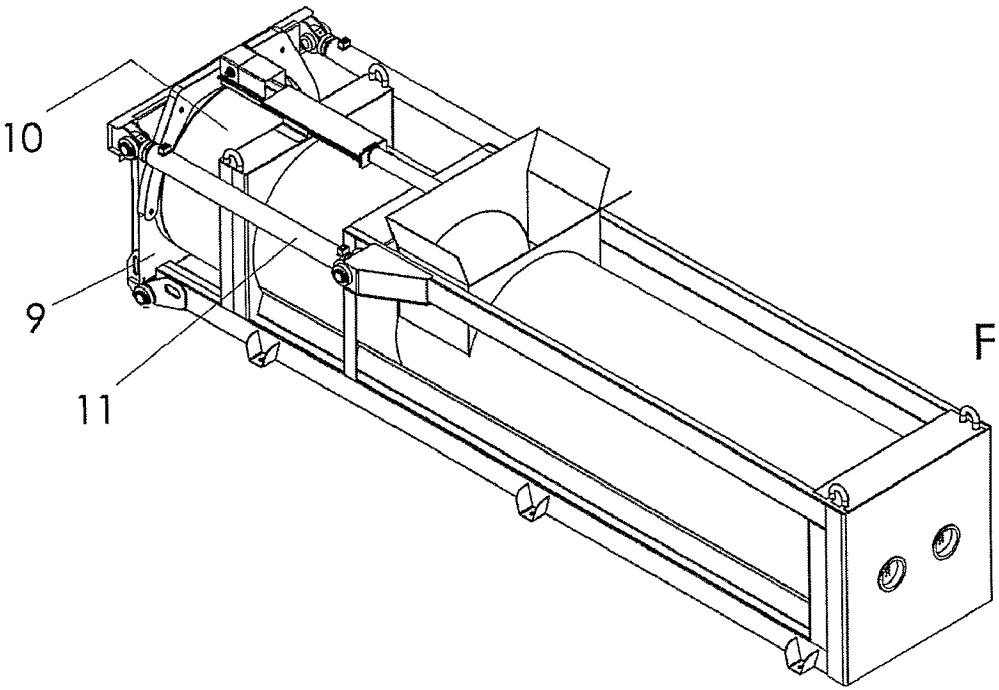
Figure 5:
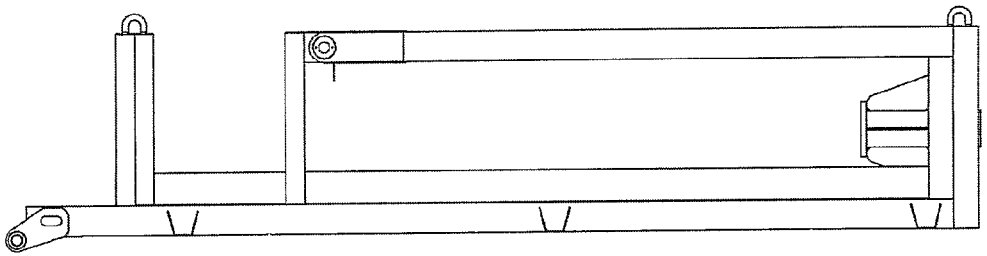
Figure 6:
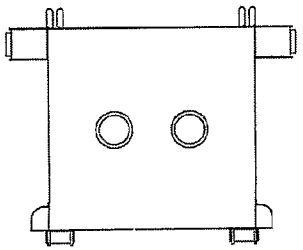
Figure 4:
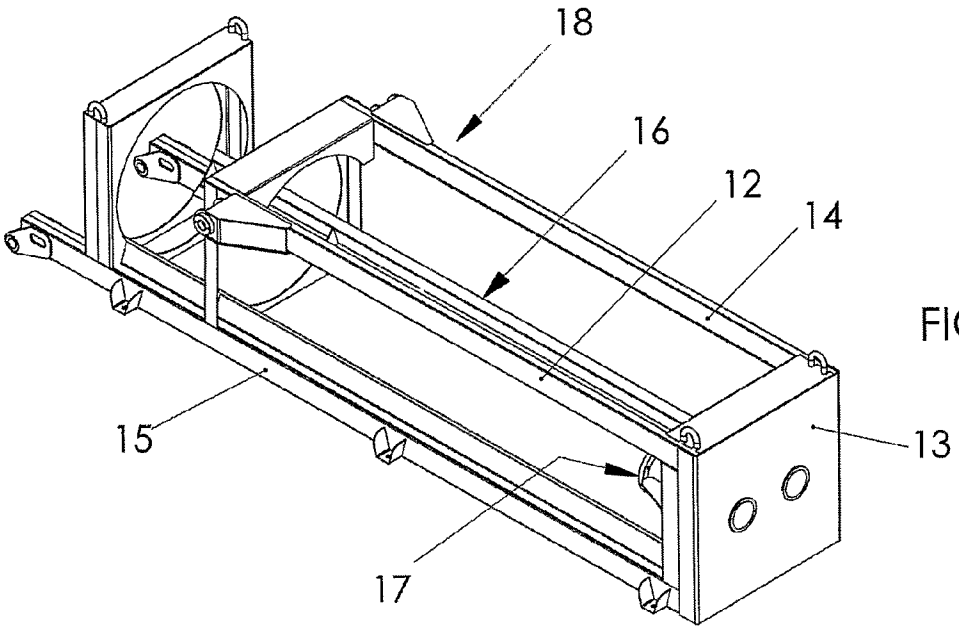
Figure 8:
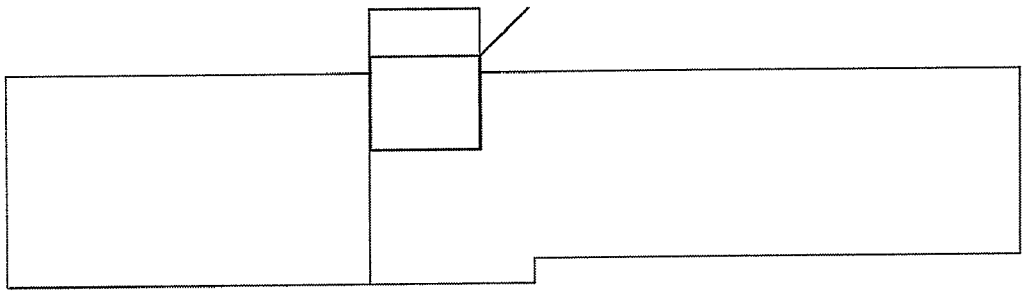
Figure 9:
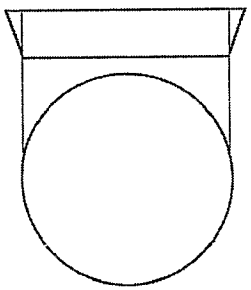
Figure 7:
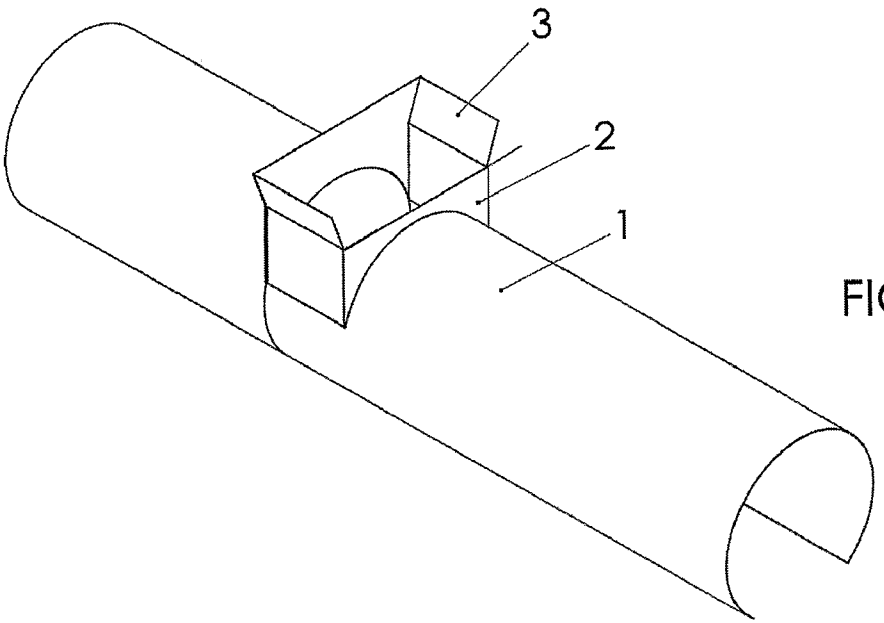
Figure 11:
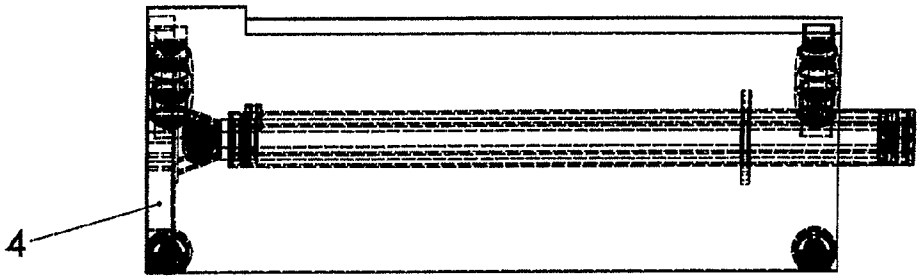
Figure 10:
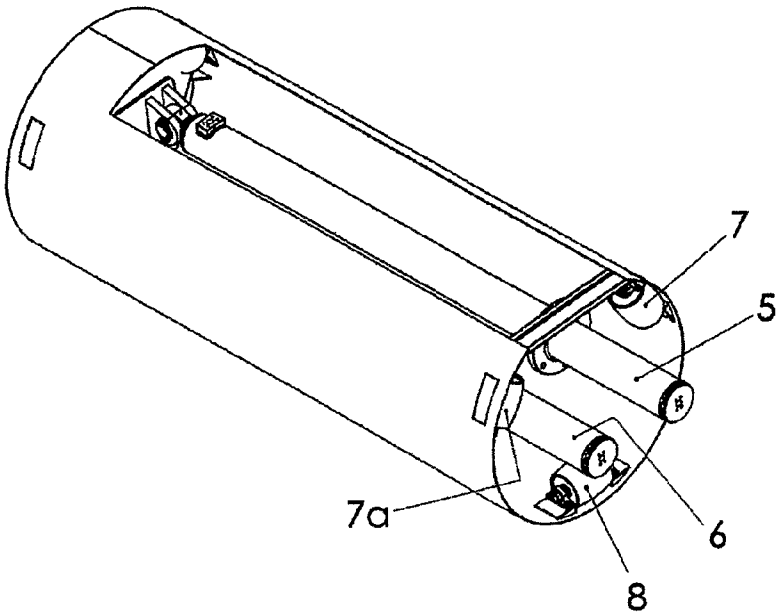
Figure 12:
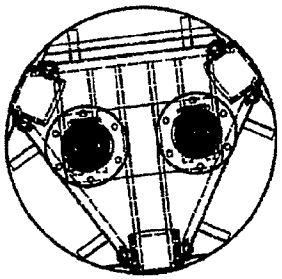

Therefore, in this case, it is as follows:

FIG. 1 is a perspective view of the proposed compacting, bagging machine;

FIG. 2 is a lateral orthogonal view of the represented equipment;

FIG. 3 is a rear orthogonal view of the bagger, the bagged and highly compacted waste coming out at the other extremity;

FIG. 4 is a perspective view of the chassis of the stationary compactor (compacting device without the main body);

FIG. 5 is a lateral orthogonal view of the compacting chassis;

FIG. 6 is a rear orthogonal view of the compacting chassis;

FIG. 7 is a perspective view of the main body (tube) of the compacting chassis;

FIG. 8 is a lateral orthogonal view of the main body; compactor;

FIG. 9 is a rear orthogonal view of the main body;

FIG. 10 is a perspective view of the compacting plate set;

FIG. 11 is a lateral orthogonal view of the compacting plate set showing its internal part; and FIG. 12 is a rear orthogonal view of the compacting plate set.

DETAILED DESCRIPTION OF THE PREFERRED EMBODIMENT OF THE UTILITY MODEL

The stationary compacting, bagging machine is a piece of equipment basically composed of:

- A monoblock chassis (18) containing a high resistance rear plate (13) from which protrude two smaller columns (12 and 14), two larger columns (15 and 16) that serve as a basis for the cylindrical body (1), the two flanked tubes (17) protruding from the plate (13), in which the hydraulic cylinders (5 and 6) are installed, which actuate the compacting plate, which, in its turn, is guided by two telescopic poles, the following being installed on said chassis:
- A cylindrical body (1) of high mechanical resistance in which waste is compacted and which also serves to host a hydraulic device that refills the machine with the bags and produces the bag refill itself. Moreover, it hosts another hydraulic device that seals the bag after filling it with the compacted waste (these two devices do not appear in the following drawings);
- A chamber (2) with baffle plates (3) to receive the waste from a feed hopper;
- A compacting plate (4) propelled by a pair of the hydraulic cylinders (5 and 6), guided by a pair of the telescopic poles, which compacts the waste against the rear gate (9), containing internal bearings (7, 7*a* and 8);
- A rear gate (9) at the extremity (10) of the cylindrical body actuated by the two hydraulic cylinders (11) whose objective, when closed, is to serve as a baffle plate for compaction of the waste, and, when opened, as a basis for ejection of the bags;
- A hydraulic system that allows refilling bags in the equipment itself;
- A hydraulic system that allows sealing the bags after compacting and bagging the waste.

The capacity of compaction and bagging of each compacting and bagging unit in the mode of 8 hours/day is estimated to be 50 tons.

The dimensions of the bags may vary but we have opted for a standard bag with the diameter of 1.60 meters and maximum length of 2.5 meters. Therefore, the average weight of each bag with compacted waste is 4.0 tons.

The invention claimed is:

1. STATIONARY COMPACTING, BAGGING MACHINE, comprising:

- a monoblock chassis (18) containing a high resistance rear plate (13) from which protrude two smaller columns (12 and 14), two larger columns (15 and 16) that serve as a basis for the cylindrical body (1), the two flanked tubes (17) protruding from the high resistance rear plate (13), in which the hydraulic cylinders (5 and 6) are installed, which actuate a compacting plate, which, in its turn, is guided by two telescopic poles, the following being installed on said chassis:
- a cylindrical body (1) of high mechanical resistance in which waste is compacted;
  - a chamber (2) with baffle plates (3) to receive the waste from a feed hopper;
  - a compacting plate (4) propelled by a pair of the hydraulic cylinders (5 and 6), guided by a pair of the telescopic poles, which compacts the waste against the rear gate (9), and internal bearings (7, 7*a* and 8);
- a rear gate (9) at the extremity (10) of the cylindrical body actuated by the two hydraulic cylinders (11).

* * * * *